US006910478B2

(12) United States Patent
Kelly et al.

(10) Patent No.: US 6,910,478 B2
(45) Date of Patent: Jun. 28, 2005

(54) DIRECT-VENT FIREPLACE CONFIGURABLE FOR TOP VENTING OR REAR VENTING

(75) Inventors: Pat Kelly, Lexington, KY (US); Mike D. Padgett, Georgetown, KY (US); Soong Jack Chow, Lexington, KY (US)

(73) Assignee: Monessen Hearth Systems Company, Paris, KY (US)

( * ) Notice: Subject to any disclaimer, the term of this patent is extended or adjusted under 35 U.S.C. 154(b) by 0 days.

(21) Appl. No.: 10/669,830

(22) Filed: Sep. 24, 2003

(65) Prior Publication Data

US 2005/0061310 A1 Mar. 24, 2005

(51) Int. Cl.[7] ..... F24C 15/20
(52) U.S. Cl. ..... 126/512; 126/85 B
(58) Field of Search ..... 126/512, 85 B, 126/307 A, 312

(56) References Cited

U.S. PATENT DOCUMENTS 5,016,609 A * 5/1991 Shimek et al. ..... 126/85 B
5,076,254 A * 12/1991 Shimek et al. ..... 126/512
5,267,552 A 12/1993 Squires et al.
5,320,086 A 6/1994 Beal et al.
5,452,708 A 9/1995 Shimek et al.
5,482,028 A 1/1996 Binzer
5,647,340 A 7/1997 Shimek et al.
5,647,341 A * 7/1997 Langman et al. ..... 126/512
5,647,342 A * 7/1997 Jamieson et al. ..... 126/512
5,941,231 A 8/1999 Garrett et al.
6,295,981 B1 10/2001 Beal et al.

* cited by examiner

*Primary Examiner*—Alfred Basichas
(74) *Attorney, Agent, or Firm*—Woodard, Emhardt, Moriarty, McNett & Henry LLP

(57) ABSTRACT

A direct-vent, gas fireplace assembly that is configurable into a top venting arrangement and alternately configurable into a rear venting arrangement includes a combustion chamber, an outer enclosure, a vent panel positioned between the combustion chamber and the outer enclosure, and an inlet/outlet subassembly. The combustion chamber utilizes outside air for the gas burner and the combustion by-products are exhausted to the outside by one of the two possible arrangements for the fireplace assembly. The vent panel is set at an approximate 45 degree angle and the inlet/outlet subassembly includes an outlet elbow having an approximate 45 degree bend. The outlet elbow includes a mounting plate that attaches to the vent panel. Depending on the orientation of the outlet elbow as mounted to the vent panel, the fireplace assembly can be configured as a top venting unit or as a rear venting unit.

13 Claims, 8 Drawing Sheets

DIRECT-VENT FIREPLACE CONFIGURABLE FOR TOP VENTING OR REAR VENTING

BACKGROUND OF THE INVENTION

The present invention relates in general to fireplace structures and, in particular, to direct-vent, gas fireplace structures. More specifically, the present invention relates to a direct-vent fireplace that may be configured in one arrangement for top venting and, in an alternate arrangement, for rear venting. The alternate arrangements are enabled by the combination of an inlet cover plate and outlet elbow. The arrangement of this inlet cover plate and outlet elbow relative to the remainder of the fireplace structure determines whether the fireplace will be a top venting unit or a rear venting unit.

U.S. Pat. No. 6,295,981 issued Oct. 2, 2001 to Beal et al. addresses a problem associated with some direct-vent, gas fireplaces namely, the difficulty in selectively and easily venting combustion gases in either a horizontal or a vertical direction. In the context of the present invention, the horizontal direction would correspond to a rear vent arrangement while the vertical direction would correspond to a top vent arrangement. The '981 patent explains some of the realities of conventional fireplace designs and discusses some of the efforts of other designers (inventors) in the following manner.

Gas fireplaces of conventional design typically utilize a source of combustion air from the room being heated. This lowers the efficiency of the gas fireplace because a portion of the heated air in the room is drawn into the combustion chamber and exhausted up the chimney. It is known to provide separate ducting from the outside ambient environment to the combustion chamber to increase the efficiency of the fireplace. The ducted air provides a source of oxygen for combustion in the combustion chamber and decreases the amount of air from the room being heated which is exhausted up the chimney. Such ducting, however, requires additional materials and labor to install.

It is also known in the art to utilize concentric flue pipes to exhaust combustion products to the outside environment and supply combustion air from the outside environment. Such fireplaces are termed "direct-vent" fireplaces and are disclosed, for example, in U.S. Pat. No. 4,793,322 (Shimek I) and U.S. Pat. No. 4,909,227 (Rieger). A direct-vent fireplace has the advantage of utilizing a common concentric flue pipe assembly to both exhaust combustion products from and supply combustion air to the combustion chamber. Moreover, only a single opening need be cut through an exterior wall of a house to accommodate the concentric flue pipe assembly.

In general, a direct-vent fireplace has a first pipe with a diameter larger than and disposed concentrically around a second pipe. The duct formed by the second pipe is used to convey exhaust products from the combustion chamber to the outside environment. The annular space formed between the first and second pipes defines a fresh air conduit through which combustion air flows from the outside ambient environment into the combustion chamber.

A problem with direct-vent gas fireplaces is that the concentric flue pipe assembly cannot be easily vented in both a horizontal or vertical direction. Shimek I and Rieger disclose direct-vent fireplaces which respectively connect the concentric flue to the rear wall and top wall of the fireplace. A concentric flue attached to the rear wall of the fireplace may be easily extended through an adjacent side-wall of the house. However, if it is desirable to exhaust the concentric flue in a vertical direction, the fireplace must be moved forward a sufficient distance to allow coupling of a right angle concentric pipe elbow. Thus, additional floor space is required to accommodate the projected footprint of the fireplace and concentric flue pipe assembly.

A concentric flue pipe assembly attached to the top of a direct-vent fireplace has a similar problem when it is desired to vent the concentric fluid in a horizontal direction (see, e.g., Rieger at Col. 1, lines 23–32). That is, the fireplace must be moved forward a sufficient distance to allow coupling of a right angle concentric pipe elbow.

Because of two possible installation configurations, i.e., vertical or horizontal venting of the concentric flue pipe assembly, it is necessary with conventional direct-vent fireplaces to provide two totally different configurations. That is, for relatively close placement of the fireplace adjacent the outside wall of the house, it is necessary to provide one configuration allowing attachment of the concentric flue pipe assembly to the back of the fireplace for horizontal venting, and a second configuration allowing attachment of the concentric flue pipe assembly to the top of the fireplace for vertical venting. The necessity to provide two different configurations increases inventory requirements at the factory. Reference can be made, for instance, to U.S. Pat. No. 5,320,086 (Shimek II) regarding the same. Shimek II is directed to a single fireplace construction that could be used in both a vertical venting configuration (i.e., relatively straight upwardly from the fireplace) of a horizontal venting configuration (i.e., relatively straight out from the back of the fireplace).

Moreover, such fireplaces should be equipped with a mechanism or process that enables one type of venting (e.g., vertical), while preventing the other type of venting (e.g., horizontal). This would allow any exhaust matter to escape the fireplace via the selected venting type, while preventing the same from escaping via the non-selected type.

Accordingly, it would be desirable to have a fireplace that overcomes the above disadvantages.

The perceived improvement offered by the '981 patent is to first provide both a top port (40) and a rear port (41). These two ports communicate with an outlet box (44) extending from the combustion chamber (11). Each port includes a bottom panel (48) defining a circular hole (49). Next, according to the '981 patent, an air inlet pipe member (60) and a separate air outlet pipe member (61) are provided. Included as part of outlet pipe member (61) is a plate portion (63) that attaches to the bottom panel (48). Inlet pipe member (60) then is assembled in a concentric manner relative to outlet pipe member (61). Inlet pipe member (60) includes an integral cover plate portion (67) that functions to close off the non-selected port.

The present invention discloses a structural configuration that enables selective fireplace conversion to either horizontal (rear) venting or vertical (top) venting. Rather than using an outlet pipe member with a cumbersome plate portion, the present invention uses two separate cover plates. The fireplace is configured with an inner panel set at approximately 45 degrees relative to the horizontal and vertical directions and defines a vent port that is in direct flow communication with the combustion chamber. One feature of the present invention is the use of an outlet elbow. One of the unexpected benefits of this design is an increase in velocity of the heated gas exiting the combustion chamber. This increase in velocity in turn increases the intake air flow thereby increasing the heat output and flame performance of the fireplace. Moreover, this structure provides the ability to attach the inlet/outlet subassembly in a first orientation or arrangement for vertical venting and in a second orientation or arrangement for horizontal venting, while using the same vent port.

The convenience and simplicity of this structure, according to the present invention, is seen as a novel and unobvious advance in the art.

SUMMARY OF THE INVENTION

A direct-vent fireplace configurable into a top venting unit in one arrangement and configurable into a rear venting unit in another arrangement according to one embodiment of the present invention comprises a combustion chamber, an outer enclosure enclosing at least a portion of a combustion chamber, the outer enclosure including a rear panel defining a rear opening and including a top panel defining a top opening, a vent panel positioned between the combustion chamber and the outer enclosure, an outlet elbow attached to the vent panel and arranged in flow communication with the combustion chamber, and an inlet cover plate surrounding a portion of the outlet elbow that extends through the outer enclosure, wherein the outlet elbow portion extends through the rear opening for achieving the rear venting arrangement and the outlet/elbow portion extends through the top opening for achieving the top venting arrangement.

One object of the present invention is to provide an improved direct-vent fireplace.

Related objects and advantages of the present invention will be apparent from the following description.

DESCRIPTION OF THE PREFERRED EMBODIMENTS

Figure 1:
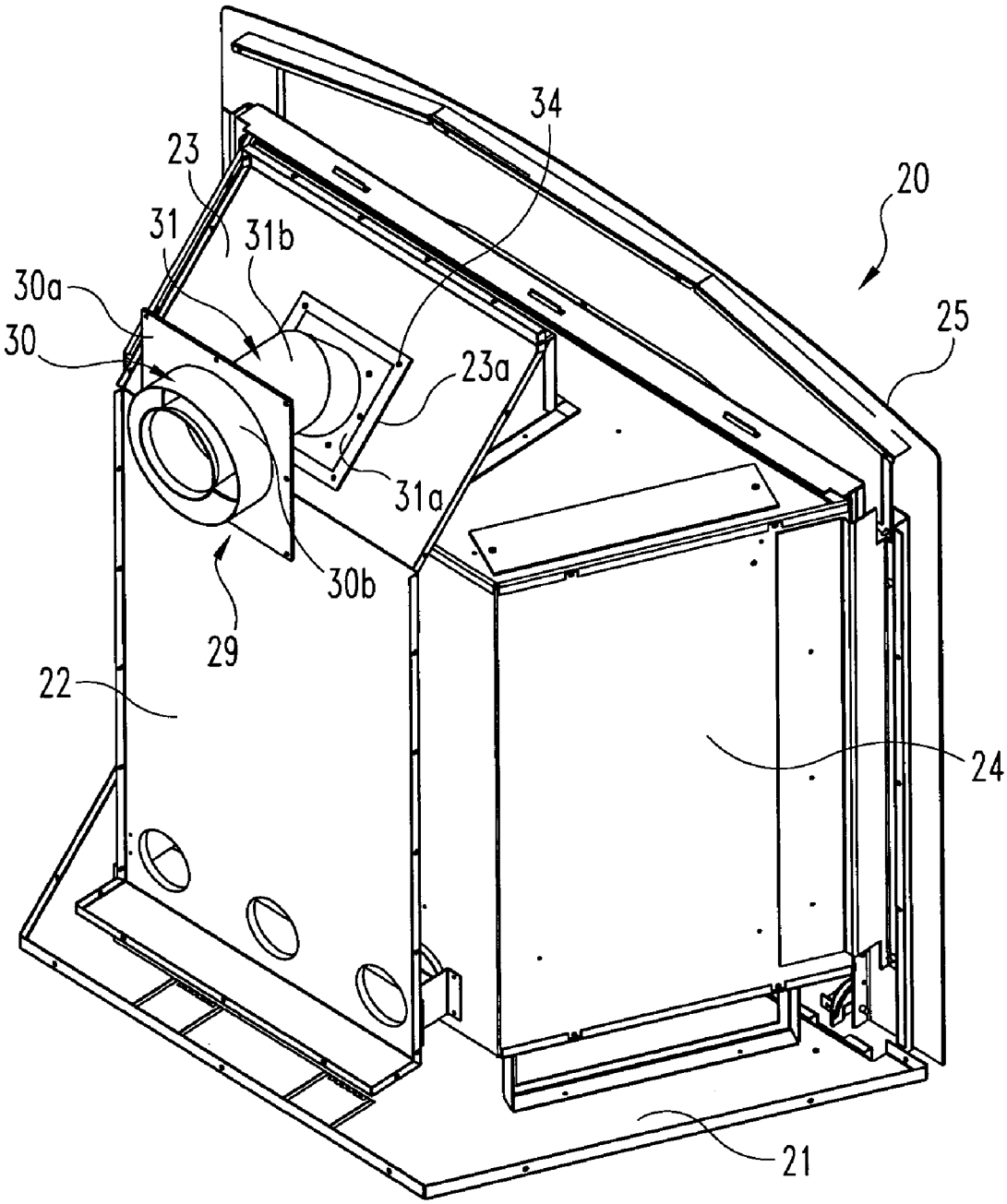
FIG. 1 is a diagrammatic, perspective view of a direct-vent, gas fireplace, without its outer enclosure, according to a typical embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
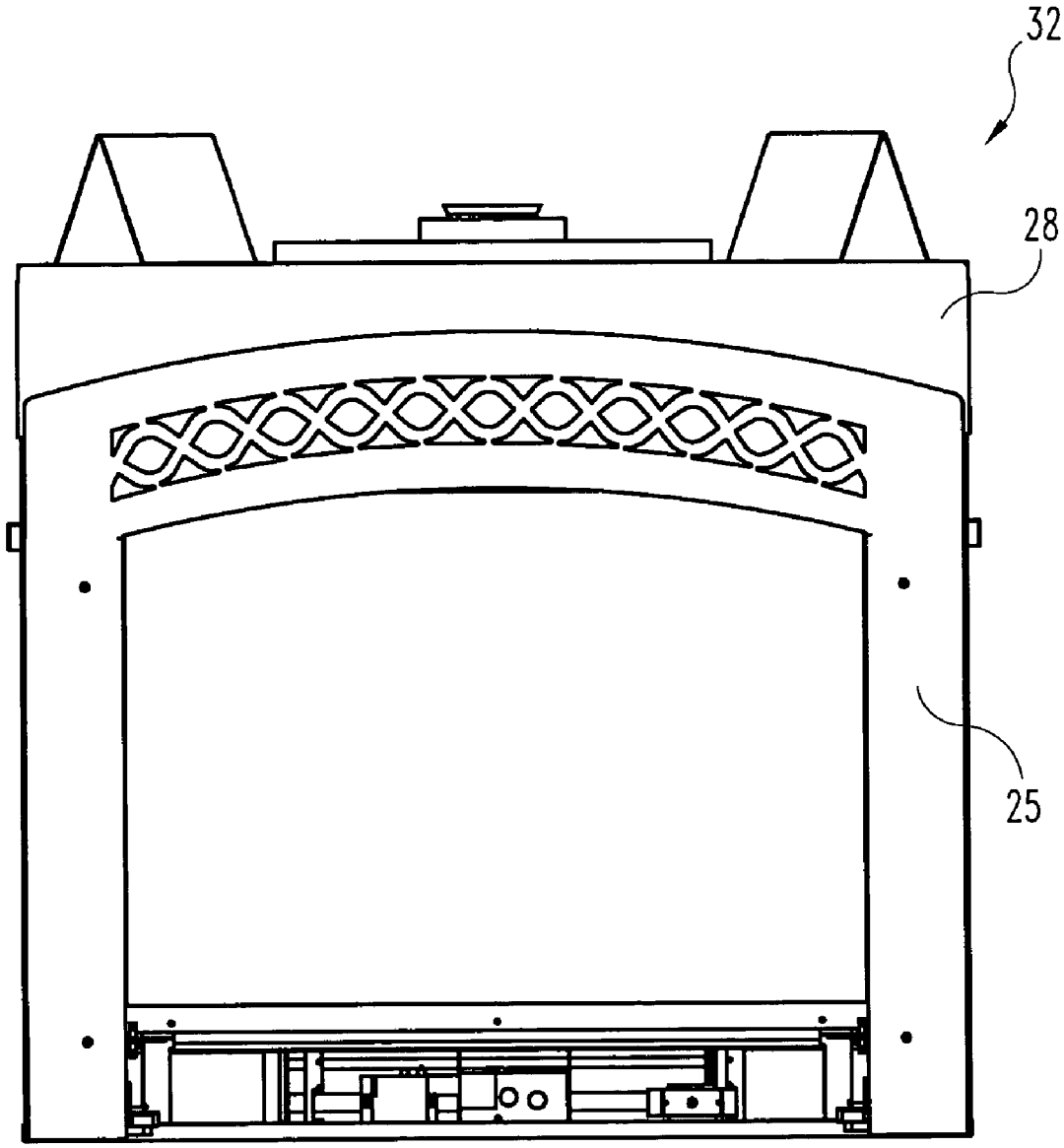
FIG. 2 is a diagrammatic, front elevational view of a fireplace assembly based in part on the FIG. 1 fireplace.
Figure 8:
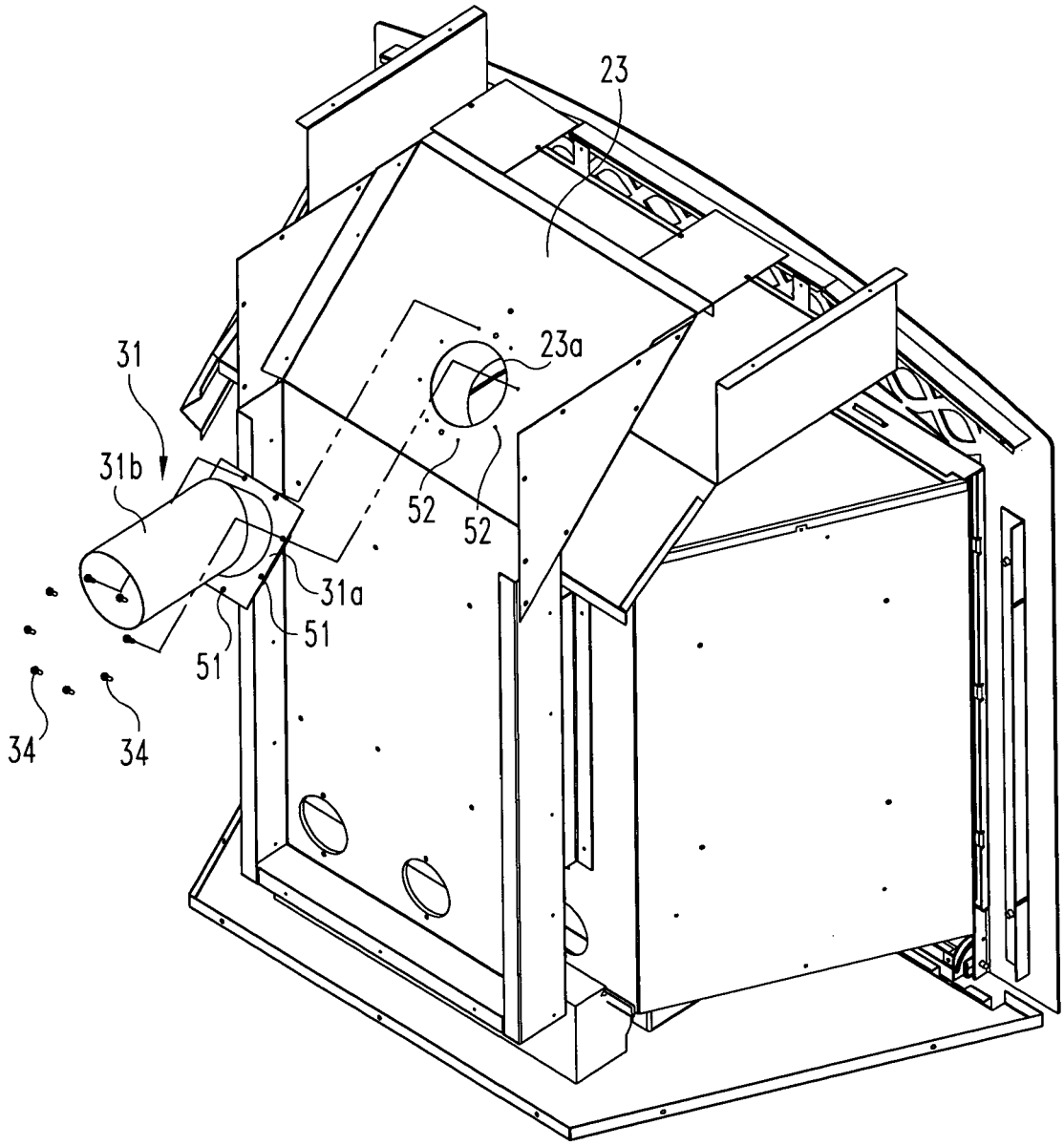
FIG. 8 is an exploded view of a direct-vent, gas fireplace, without its outer enclosure, depicting the attachment of the outlet elbow.
Figure 9:
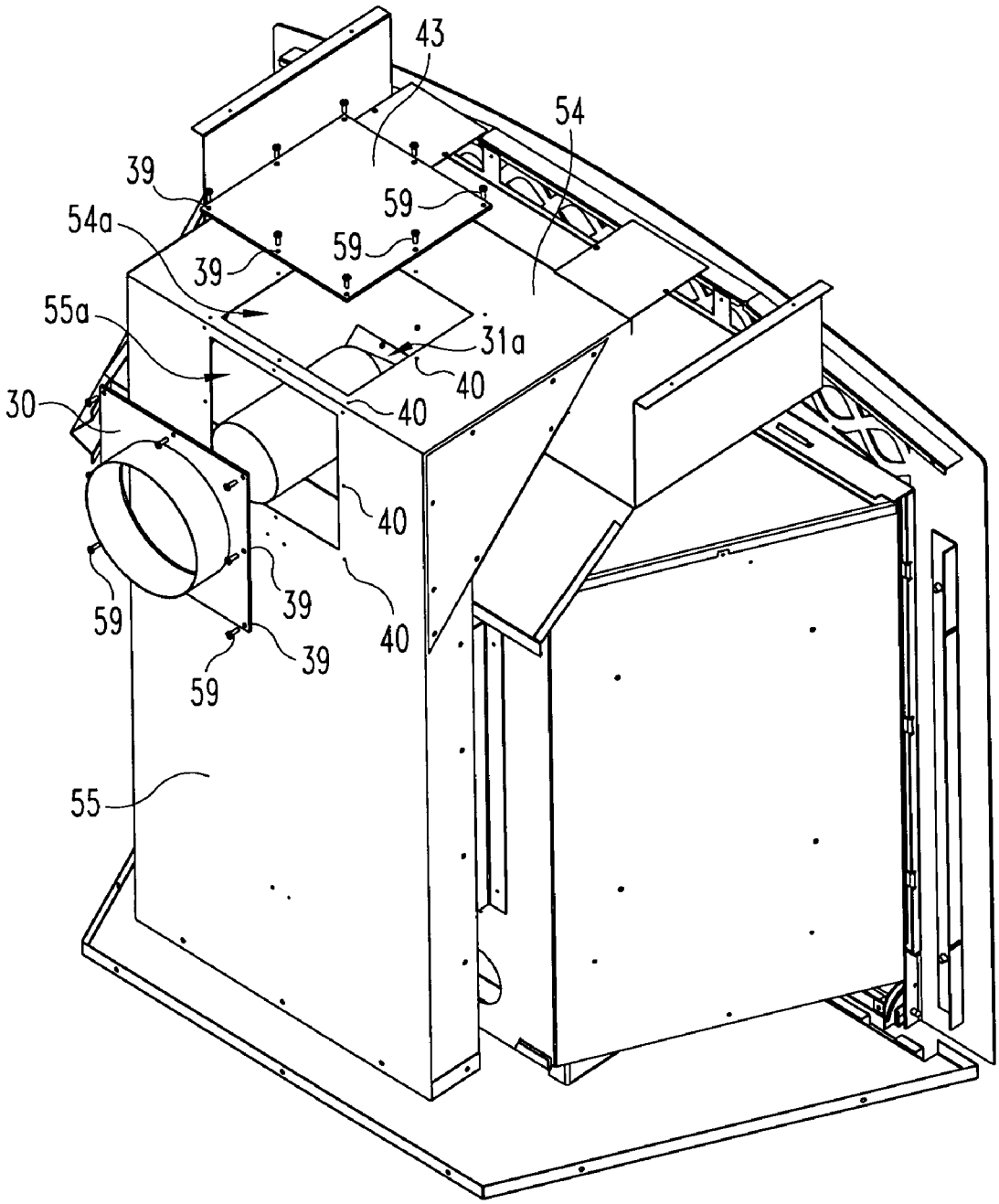
FIG. 9 is a partially exploded view of the FIG. 8 fireplace assembly with enclosing panels included, depicting the attachment of cover plates to the enclosing panels.
Figure 10:
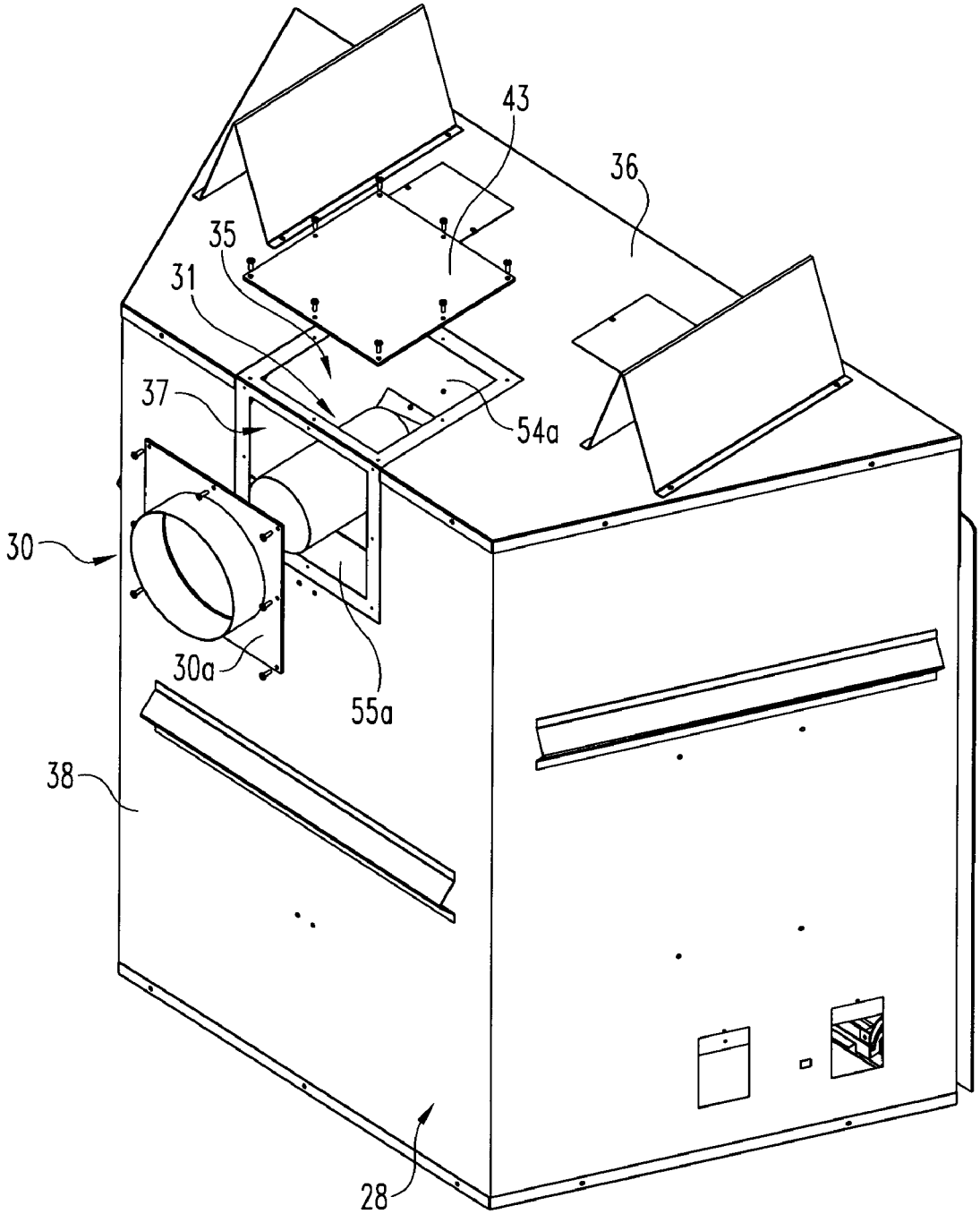
FIG. 10 is a partially exploded view of the FIGS. 8 and 9 fireplace assembly, with an outer enclosure added.

Referring to FIG. 1, there is illustrated a gas fireplace 20 that is constructed and arranged for direct-venting of combustion gases. Fireplace 20 is diagrammatically illustrated and includes various sheet metal panels that provide, among other structural components, a base 21, rear panel 22, and vent panel 23. A combination of sheet metal panels are constructed and arranged in order to create the illustrated fireplace combustion chamber 24. The front wall 25 of the fireplace 20 is typically a combination of metal and glass, serving both decorative and performance functions. The actual construction details regarding the front wall 25, base 21, and combustion chamber 24 are considered to be secondary to the primary points of focus of the present invention. Accordingly, a majority of the discussion regarding the present invention is directed to rear panel 22 and vent panel 23, as well as to the outer enclosure 28 that cooperates with fireplace 20 in order to create a fireplace assembly 32. Two slightly different fireplace assemblies or arrangements are illustrated according to the present invention. A top or vertical venting arrangement is diagrammatically illustrated in FIGS. 2–4. A rear or horizontal venting arrangement is diagrammatically illustrated in FIGS. 5–7. The partially exploded views of FIGS. 8, 9 and 10 illustrate the sequential build up of panels to complete the fireplace assembly 32 for a rear venting arrangement. In both the top venting and rear venting arrangements, it will be noted that vent panel 23 remains in the same assembled location and orientation with an approximate 45 degree incline relative to horizontal and vertical directions. Anticipating a normal or conventional fireplace installation, it would be expected for the front wall 25 of the fireplace to be substantially vertical and substantially parallel to the rear panel 38 of the outer enclosure 28. Likewise, it would be expected that the base 21 would be positioned so as to be substantially horizontal and substantially parallel to the top panel 36 of the outer enclosure 28.

The primary focus of the present invention is directed to a cooperating combination of an inlet component (cover plate) 30 and an outlet component (outlet elbow) 31, referred herein as "subassembly" 29. More specifically, the focus of the present invention is directed to the options for attaching the outlet elbow 31 to vent panel 23. The inlet and outlet components work together as an unit and as part of the fireplace assembly 32 that includes fireplace 20, interior sheet metal panels and outer enclosure 28. Since the fireplace assembly 32 includes the same grouping of component parts, albeit in two different arrangements, reference number 32 is used for both arrangements. As is illustrated, the inlet cover plate 30 includes a mounting plate 30*a* and an integral cylindrical sleeve 30*b*. The outlet elbow 31 includes a mounting plate 31*a* and an integral elbow conduit 31*b*, having an approximate 45 degree bend (i.e., 135 degree included angle).

Vent panel 23 is positioned between the combustion chamber 24 and the outer enclosure 28. The vent panel 23 is angled approximately 45 degrees relative to the top panel 36 and rear panel 38. This orientation represents the normal or expected orientation for the fireplace assembly 32 within the structure where it will be installed.

Vent panel 23 includes a generally square opening 23*a* that is constructed and arranged to receive mounting plate 31*a* of outlet elbow 31. The specific style of attachment is not critical so long as plate 31*a* closes off opening 23*a*, except for the venting of combustion gas by way of conduit 31*b*. One or more removable fasteners 34 are used to secure plate 31*a* to vent panel 23.

Figure 6:
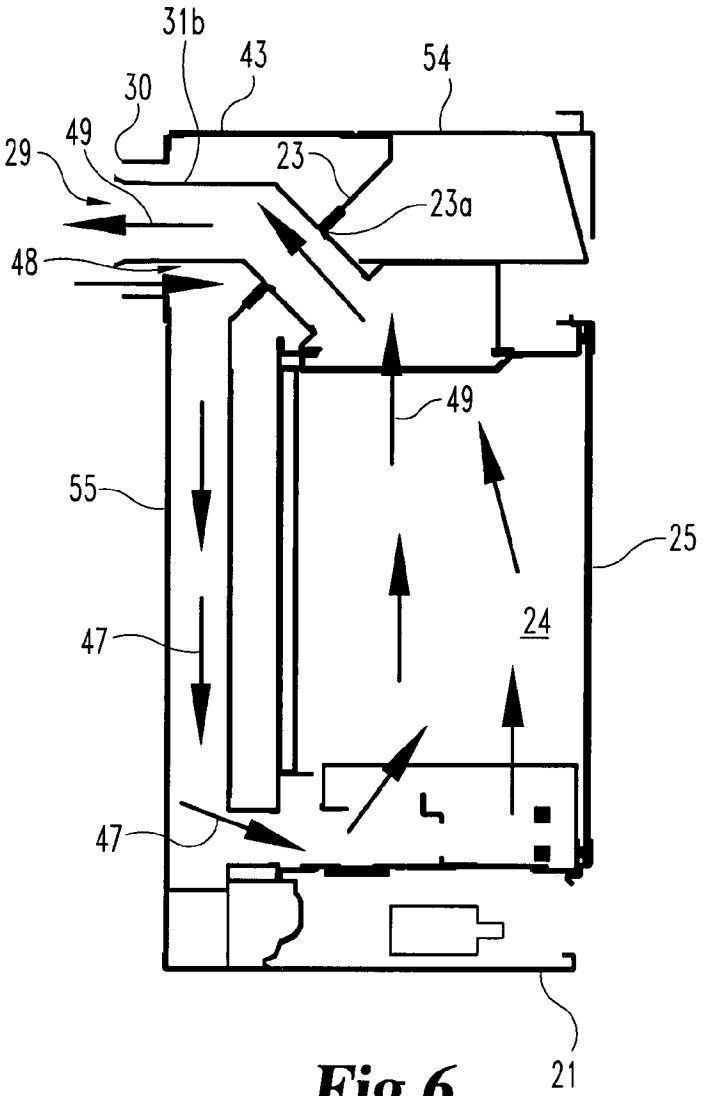
FIG. 6 is a diagrammatic, side elevational view, in full section, corresponding to the FIG. 5 fireplace arrangement.
Figure 7:
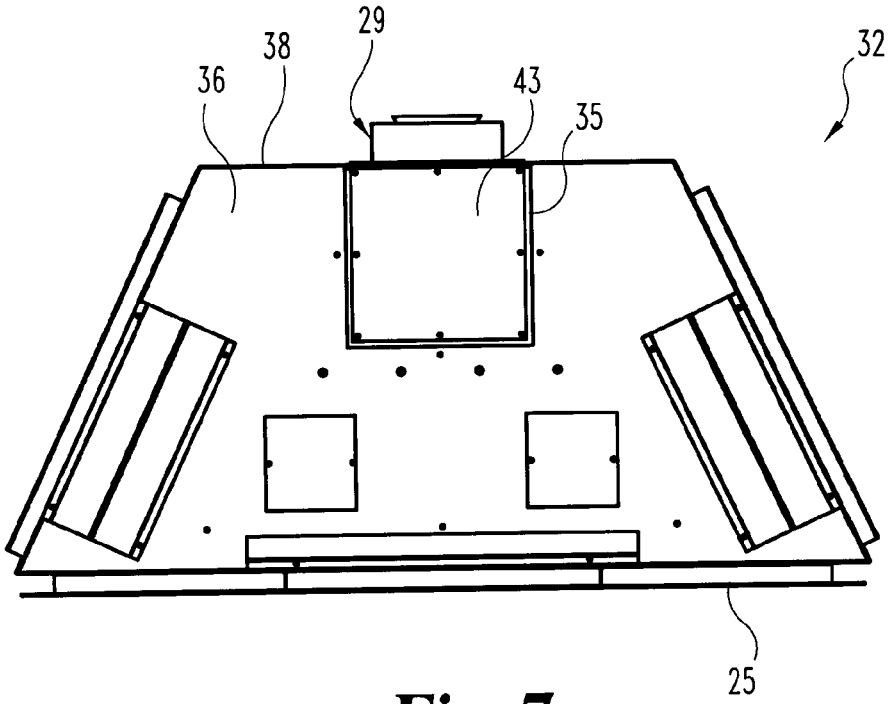
FIG. 7 is a diagrammatic, top plan view of the FIG. 2 fireplace arrangement.
Figure 4:
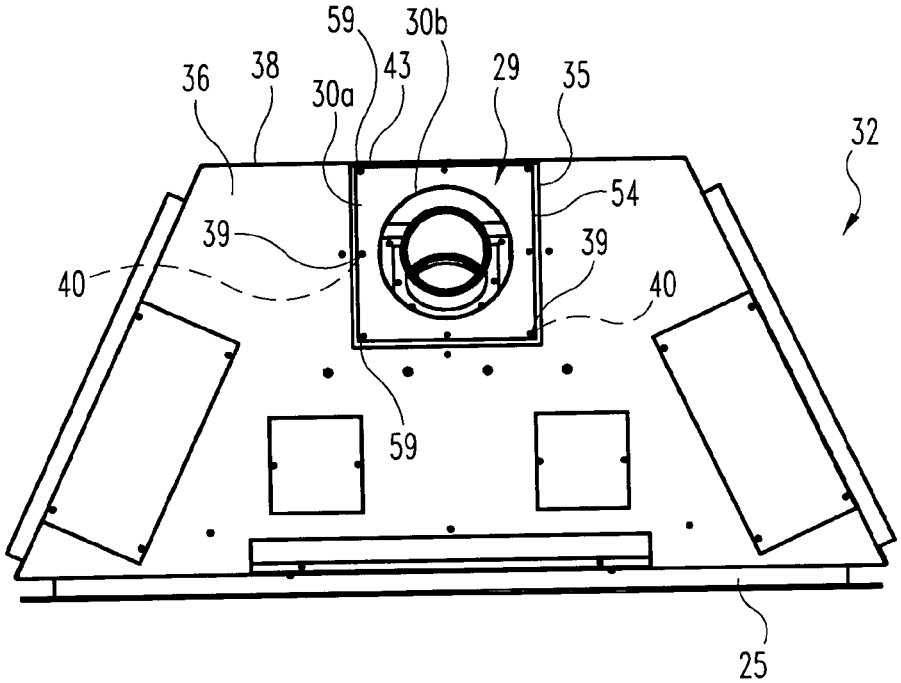
FIG. 4 is a diagrammatic, top plan view of the FIG. 2 fireplace arrangement.
Figure 5:
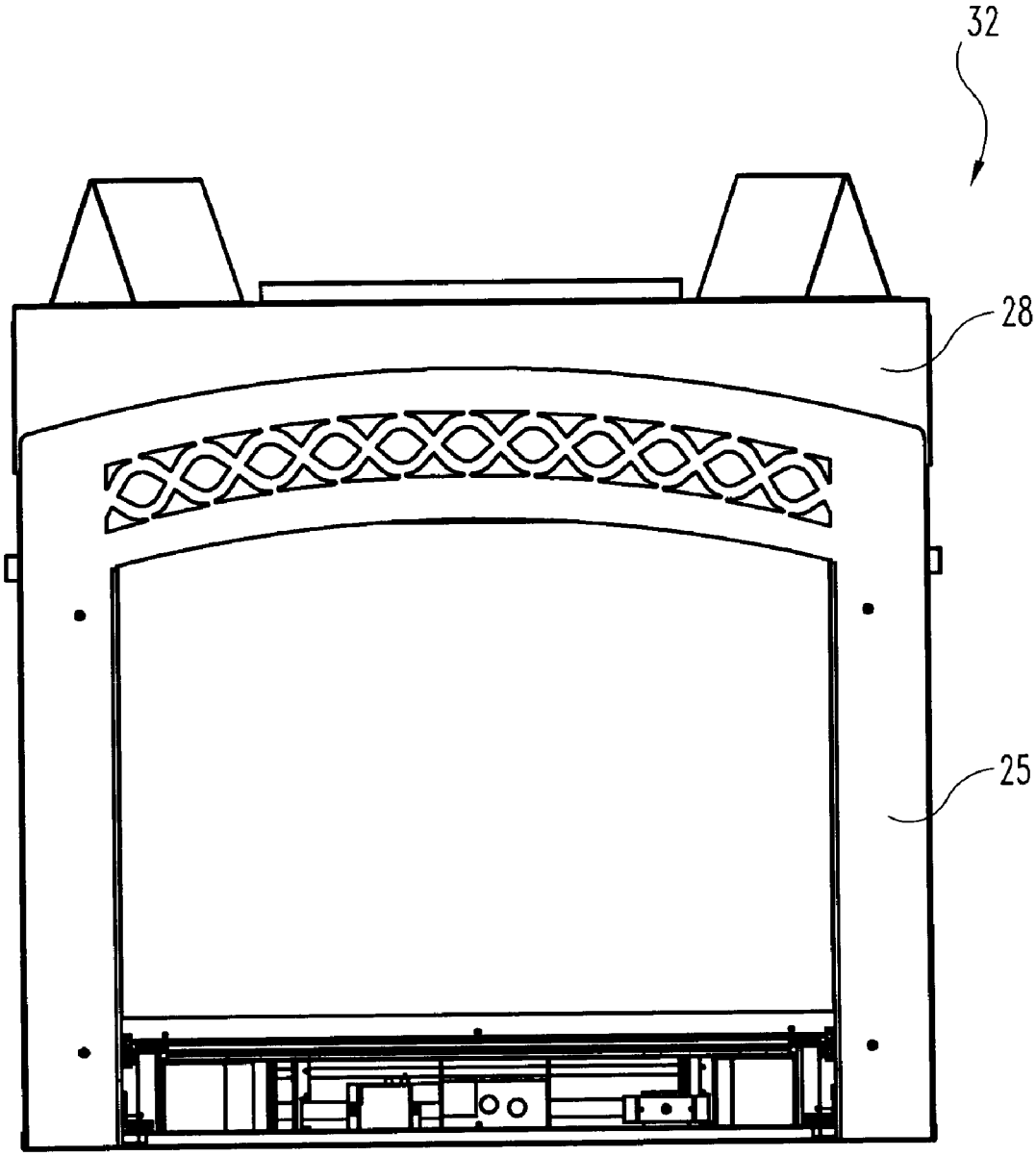
FIG. 5 is a diagrammatic, front elevational view of a fireplace assembly based in part on the FIG. 1 fireplace.

In the FIG. 1 illustration, the mounting plate 31*a* of subassembly 29 is attached directly to vent panel 23 for the venting of combustion gas from the rear of the fireplace assembly 32 (see FIGS. 5–7). By turning the outlet elbow 31 180 degrees, the fireplace assembly 32 is configured for the venting of combustion gas from the top of the fireplace assembly 32 (see FIGS. 2–4). Regardless of how the fireplace assembly 32 may be initially configured for the intended installation, it can be readily changed to the other configuration or arrangement by simply removing the fasteners 34, turning the mounting plate 31*a* 180 degrees, and reinserting the removable fasteners 34. This change in configuration not only changes the fireplace assembly 32 from a rear vent arrangement to a top vent arrangement (or vice versa), but it also changes where the mounting plate 30*a* of the inlet cover plate 30 should be affixed. Additionally, this change in arrangement changes which portion of the outer enclosure, either the rear panel 38 or the top panel 36, is used for exhausting of the combustion gases.

The fireplace assembly 32 includes, in combination, the fireplace 20, interior panels 54 and 55, the outer enclosure 28, and the inlet/outlet subassembly 29. The arrangement of these components and subassemblies is diagrammatically illustrated in FIGS. 2–7 and as partially exploded views in FIGS. 8–10. As illustrated, the outer enclosure 28 includes an opening 35 in top panel 36 and there is a similarly sized and shaped opening 37 in rear panel 38. The FIG. 1 configuration for fireplace 20, corresponding to FIGS. 5–7 and 8–10, positions the mounting plate 30*a* of inlet cover plate 30 on the intermediate panel 55 at a location (opening 55*a*) that is aligned with opening 37. The arrangement corresponding to FIGS. 2–4 positions the mounting plate 30*a* of inlet cover plate 30 on the intermediate panel 54 at a location (opening 54*a*) that is aligned with opening 35. In FIG. 4, plate 30*a* includes a plurality of peripheral mounting (clearance) holes 39 and a cooperating series of internally-threaded inserts 40 (or captured nuts) that are located in panel 54 around the periphery of opening 54*a*. A generally concentric relationship is maintained between the conduit 31*b* of outlet elbow 31 and the cylindrical sleeve 30*b* of inlet cover plate 30.

With continued reference to FIG. 4, the disclosed design allows mounting plate 30*a* to be positioned through opening 35 and attached to panel 54 by the use of threaded fasteners 59 extending through clearance holes 39 and received by threaded inserts 40. This leaves opening 55*a* uncovered and, in order to close off this opening and complete fireplace assembly 32, a cover plate 43 is used and is attached to panel 55 in the same way that plate 30*a* is attached to panel 54. In fact, as will be clear, not only are the size and shape of openings 54*a* and 55*a* virtually identical, but the number, location, and spacing of the internally-threaded inserts 40 associated with both openings are virtually identical. Openings 35 and 37 are slightly larger than openings 54*a* and 55*a* and are aligned respectively. This means that plate 30*a* can either be positioned over opening 55*a* and attached to panel 55 or positioned over opening 54*a* and attached to panel 54. Likewise, cover plate 43 can either be positioned over opening 54*a* and attached to panel 54 or positioned over opening 55*a* and attached to panel 55. It is intended that the inlet/outlet subassembly 29 and cover plate 43 will be used together.

Figure 3:
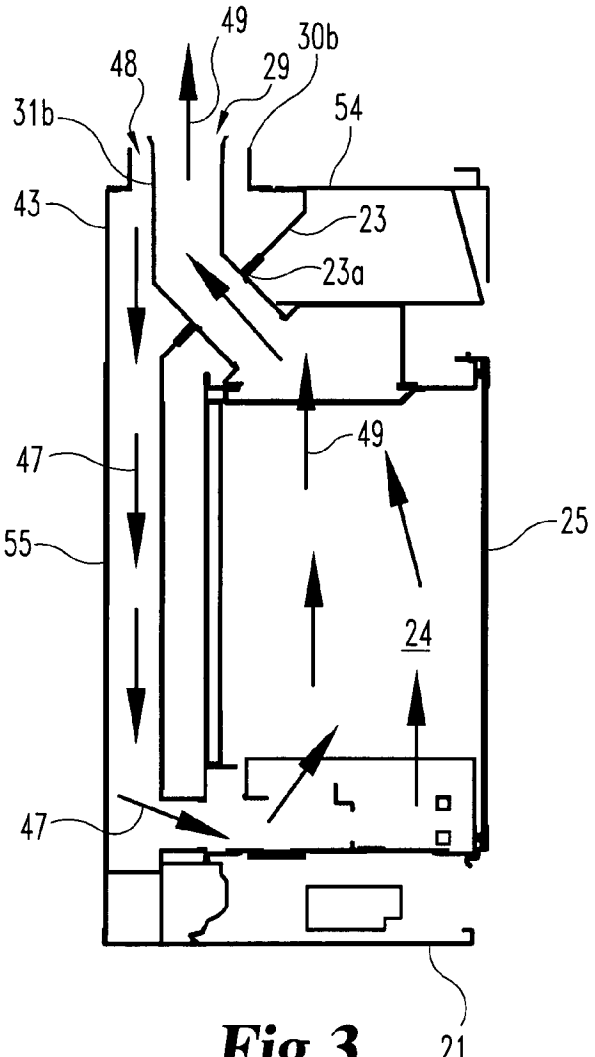
FIG. 3 is a diagrammatic, side elevational view, in full section, corresponding to the FIG. 2 fireplace arrangement.

From the diagrammatic illustrations of FIGS. 3 and 6, it will be seen that the incoming combustion air is represented by arrows 47 and this air flows through the generally annular ring corridor 48 defined by the concentric arrangement of conduit 31*b* and sleeve 30*b*. The combustion gases (combustion by-products) are exhausted from the combustion chamber 24 by way of subassembly 29 as represented by flow arrows 49. Ambient air enters through annular ring corridor 48 as combustion by-products exit as represented by flow arrows 47. The exit velocity of the combustion gases (combustion by-products) is increased through the arrangement of subassembly 29 and the vent panel 23 creating an initially angled exit of combustion gases through outlet elbow 31. The exit velocity of the hot gases is increased because of a vertical velocity component. The initial angled exit allows the exit velocity to overcome any resistance created at the elbow.

In the exploded views of FIGS. 8–10, it is better seen how subassembly 29 is composed and combined with the intermediate panels 54 and 55 and with outer enclosure 28. Outlet elbow 31 is attached to vent panel 23 by covering the opening 23*a* with the mounting plate 31*a*. Mounting plate 31*a* is firmly affixed to panel 23 by passing threaded fasteners 34 through clearance holes 51 in mounting plate 31*a* and into holes 52 in panel 23. The fasteners 34 are preferably of a type that allows easy insertion and removal in light of the difficulty for an user to manually work with the threaded end during insertion. It is envisioned that a captured nut or threaded insert will be used in holes 52 to receive fasteners 34. The outlet elbow 31 is positioned in FIG. 8 for venting of combustion gas from the rear of the fireplace assembly 32. The vent plate 23 is positioned approximately 45 degrees in relation to the intermediate panels 54 and 55, top enclosure panel 36, and rear panel 38. The outlet elbow bends approximately 45 degrees to provide an initial angled exit for the exhaust gas and either a vertical or horizontal final exit from the fireplace assembly 32. As mentioned earlier, this arrangement adds a vertical velocity component for the gases during the initial angled exit thereby improving air intake and heat output.

Beginning with the FIG. 8 fireplace subassembly, the next step or layer in the fabrication process is the addition of intermediate sheet metal panels 54 and 55 (see FIG. 9). These two panels are horizontal and vertical and are securely joined together and to the remainder of the FIG. 8 structure. Additional sheet metal panels may be utilized as part of this overall fabrication process in order to construct a strong and secure fireplace. However, with regard to the present invention, the focus will be on the use of the top (intermediate) panel 54 and the rear (intermediate) panel 55.

Top panel 54 includes opening 54*a* that is either closed by cover plate 43 using threaded fasteners 59 (as illustrated) or receives inlet cover plate 30 when a top venting arrangement is selected. Rear panel 55 includes opening 55*a* that either receives inlet cover plate 30 by using threaded fasteners 59 (as illustrated) or receives cover plate 43 when a top venting arrangement is selected.

Referring to FIG. 10, the outer enclosure 28 is added to the FIG. 9 structure so as to enclose the fireplace assembly and the intermediate panels. Included as part of enclosure 28 are top panel 36 and rear panel 38. Panel 36 includes opening 35 that is aligned with opening 54*a*. Panel 38 includes opening 37 that is aligned with opening 55*a*. The larger opening size for openings 35 and 37 allows the threaded fasteners used for inlet cover plate 30 and for outlet elbow 31 to remain accessible without having to remove the outer enclosure. Depending on the venting arrangement selected, the conduit 31*b* of the outlet elbow 31 extends through the corresponding panels, either panels 54 and 36 for top venting or panels 55 and 38 for rear venting.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A direct-vent fireplace assembly configurable into a top venting unit in one arrangement and configurable into a rear venting unit in another arrangement, said direct-vent fireplace assembly comprising:

a combustion chamber;

a plurality of intermediate panels enclosing at least a portion of said combustion chamber, said plurality of intermediate panels including a rear panel defining a rear opening and including a top panel defining a top opening;

a vent panel positioned exterior to said combustion chamber;

an outlet elbow attached to said vent panel and arranged in flow communication with said combustion chamber, a portion of said outlet elbow extending through said rear opening for achieving said rear venting arrangement and alternately said portion extending through said top opening for achieving said top venting arrangement; and an inlet cover plate constructed and arranged to surround a portion of the outlet elbow to define an air inlet passage, said inlet cover plate being attached to said rear panel for said rear venting arrangement or to said top panel for said top venting arrangement.

2. The direct-vent fireplace assembly of claim 1 wherein said inlet cover plate includes a mounting plate portion and a sleeve portion.

3. The direct-vent fireplace assembly of claim 1 wherein said outlet elbow further includes a mounting plate portion and a conduit portion.

4. The direct-vent fireplace assembly of claim 3 wherein said sleeve portion and said conduit portion are arranged substantially concentric with each other.

5. The direct-vent fireplace assembly of claim 4 wherein said outlet elbow conduit portion includes a bent portion having an obtuse included angle.

6. The direct-vent fireplace assembly of claim 5 wherein said rear panel and said top panel are constructed and arranged so as to be substantially perpendicular to each other.

7. The direct-vent fireplace assembly of claim 6 wherein said vent panel is constructed and arranged at a generally 45 degree angle relative to said top panel and relative to said rear panel.

8. The direct-vent fireplace assembly of claim 7 which further includes a cover plate for closing off whichever opening is not used for venting.

9. The direct-vent fireplace assembly of claim 1 wherein said sleeve portion and said conduit portion are arranged substantially concentric with each other.

10. The direct-vent fireplace assembly of claim 9 wherein said outlet elbow conduit portion includes a bent portion having an obtuse included angle.

11. The direct-vent fireplace assembly of claim 1 wherein said rear panel and said top panel are constructed and arranged so as to be substantially perpendicular to each other.

12. The direct-vent fireplace assembly of claim 11 wherein said vent panel is constructed and arranged at a generally 45 degree angle relative to said top panel and relative to said rear panel.

13. The direct-vent fireplace assembly of claim 1 which further includes a cover plate for closing off whichever opening is not used for venting.

* * * * *